United States Patent [19]

Gudzenko et al.

[11] 4,028,009

[45] June 7, 1977

[54] JET PUMP

[76] Inventors: Nikolai Vasilievich Gudzenko, ulitsa Krasnolimanskaya, 35, kv. 1; Mikhail Efimovich Zaichenko, ulitsa Saljutnaya, 21, kv. 47; Konstantin Leonidovich Larin, ulitsa Arsenalnaya, 15, kv. 9, all of Kiev, U.S.S.R.

[22] Filed: Sept. 24, 1975

[21] Appl. No.: 616,398

[52] U.S. Cl. ..... 417/163; 166/51; 302/25; 417/171; 417/179; 417/196

[51] Int. Cl.[2] ..... F04F 5/22

[58] Field of Search ..... 417/160, 163, 165, 166, 417/171, 179, 180, 182, 196, 197, 198; 302/24, 25, 58; 166/51, 278

[56] References Cited

UNITED STATES PATENTS

| | | | |
|---|---|---|---|
| 822,379 | 6/1906 | Luckenbach | 302/25 |
| 1,512,156 | 10/1924 | Baumann | 417/179 |
| 2,372,461 | 3/1945 | Uren | 166/151 |
| 3,442,337 | 5/1969 | Astrom | 175/213 X |
| 3,672,790 | 6/1972 | White et al. | 417/197 X |

*Primary Examiner*—William L. Freeh
*Assistant Examiner*—Edward Look

[57] ABSTRACT

Two circular rows of through channels in the walls of the pump mixing chamber serve to admit the conveying fluid into said chamber. The axes of the channels in one row are inclined to the cross-sectional plane of the mixing chamber and to the plane passing through its longitudinal axis, thus forming a vortex stage. The axes of the channels in the other row are inclined only to the cross-sectional plane of the mixing chamber, thus forming an injecting stage. The distance between the stages is selected so as to arrange the points of intersection of the channel axes of the vortex stage and the point of intersection of the channel axes of the injecting stage in one and the same plane which is perpendicular to the longitudinal axis of the mixing chamber.

This pump can be used in devices for sucking in, conveying and placing loose materials, for lifting slurry in rotary drilling of wells with the well face cleaned by the indirect flushing method and in the devices for the preparation of clayey suspension.

15 Claims, 6 Drawing Figures

JET PUMP

The present invention relates to devices for transferring loose and liquid media and more particularly it relates to jet pumps. The jet pumps according to the invention can be used extensively in agriculture, building, ore-mining industry, hydrogeology and elsewhere where it is necessary to convey fluids containing fine and coarse inclusions, organic matter and to carry and place loose materials such as grain, sand, gravel, crushed stone, etc.

The present invention will be most practicable in filling the space around the filters with sand while making wide wells in the zone of a water-bearing horizon for extraction of water. Besides, the present invention can prove useful in drilling holes for water drawdown work and drilling hydrogeological wells by the indirect flushing method. Finally, the present invention can also be used for the preparation of clayey solutions and flushing liquids.

Known at present is a jet pump (see U.S. Pat. No. 3,672,790, Cl. 417-108, USA) comprising a mixing chamber whose walls have peripheral through channels communicating with a source of the conveying fluid for its admission into the chamber. Each channel is inclined at an angle different from the angles of the other channels to the cross-sectional plane of the mixing chamber in the direction of flow of the transferred fluid and, additionally, at an angle different from the angles of the other channels to the plane passing through the longitudinal axis of the mixing chamber and through the point where the axis of the corresponding channel intersects the outer surface of the mixing chamber. This pump has to submerged into the transferred fluid before work and has but a small suction lift.

The arrangement of each mixing chamber channel at the angles which differ from the inclination angles of the other channels causes local vertical swirls in the conveying fluid which offer resistance to the movement of the transferred fluid. Besides, the fluid column formed in the mixing chamber in the case of the spiral arrangement of the channels has a high pressure only on its periphery so that the area through the chamber is not utilized completely. These factors are responsible for the low efficiency of the known pump.

The small suction lift of the pump (within 4 m) and the necessity for preliminary submersion of the pump into the transferred fluid make the pump unsuitable for drilling wells. And, finally, one of the disadvantages of the known pump lies in the impossibillity of using it for handling liquids with large inclusions.

An object of the present invention lies in eliminating the aforesaid disadvantages.

Another object of the present invention is to provide a pump which would be capable of conveying not only liquid media but also such loose materials as sand, gravel, grain, crushed stone, etc.

The main object of the invention is to arrange the channels in the mixing chamber in such a manner that the conveying fluid passing through said channels would acquire rotary and progressive motion thus creating the so-called "artificial whirlwind".

This object is achieved by arranging the channels of the mixing chamber in at least two circular rows located one after the other, the axis of each channel in the first row along the flow of the transferred fluid being inclined at the same angle to the cross-sectional plane of the mixing chamber in the direction of flow of the transferred fluid, and being additionally inclined to the plane passing through the longitudinal axis of the mixing chamber and through the point where the axis of the corresponding channel intersects the outer surface of the mixing chamber, thus forming a vortex stage, while the axis of each channel in the other row is inclined at the same angle only to the cross-sectional plane of the mixing chamber, forming an injecting stage; the distance between these rows is selected in such a manner that the points of intersection of the channel axes of the vortex stage with the inner surface of the mixing chamber and the points of intersection of the channel axes of the injecting stage would lie in one and the same plane which is perpendicular to the longitudinal axis of the chamber.

To provide for the best conditions of forming the artificial whirlwind and to prevent formation of local swirls in the column of the conveying fluid the angles formed by the axis of each channel of the vertex stage with the cross-sectional plane of the mixing chamber are the same and vary from 60° to 70° while the angles formed with the plane passing through the longitudinal axis of the chamber and through the point where the axes of the corresponding channels intersect the outer surface of the mixing chamber are the same and vary from 29° to 31°.

To build up a high-pressure zone along the longitudinal axis of the mixing chamber and to ensure a more complete utilization of its cross-sectional area, the angles formed by the axis of each channel in the injecting stage with the cross-sectional plane of the mixing chamber are the same and vary from 60° to 70°.

Such an arrangement of the pump channels makes it possible to create an artificial whirlwind in the pump mixing chamber which increases the suction lift almost three times (about 12 m) and steps up its efficiency by eliminating losses due to local swirls and by utilizing the entire area through the chamber.

The pump according to the invention can also be used for pumping slurry from drill holes.

Now the invention will be described in detail by way of example with reference to the accompanying drawings, in which.

Figure 1:
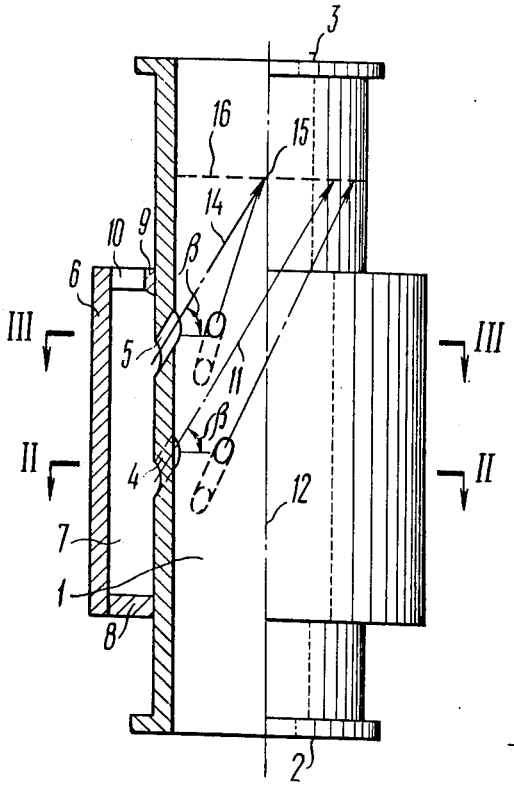
FIG. 1 illustrates a partial longitudinal section through the jet pump.

The jet pump according to the invention comprises a mixing chamber 1 (FIG. 1) in the form of a hollow cylinder having an inlet end 2 and an oulet end 3. Two rows 4 and 5 of through channels in the walls of the mixing chamber 1 are in communication with the inner space of the device which delivers the conveying fluid into the mixing chamber 1. Said device is constituted by a header 6 in the form of a cylindrical chamber whose diameter is larger than that of the mixing chamber 1 and forms a circular gap 7 with the walls of the mixing chamber 1. Said cylindrical chamber surrounds the rows of channels 4 and 5 and is sealed hermetically on two sides with flanges 8 and 9. One of the flanges 9 has holes 10 through which the conveying fluid is fed from the fluid source (not shown in the drawing) into the mixing chamber 1.

Figure 3:
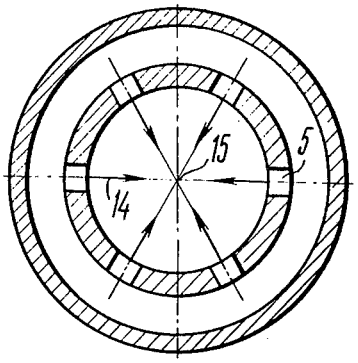
FIG. 3 is a section taken along line III—III in the injecting stage of the jet pump.
Figure 2:
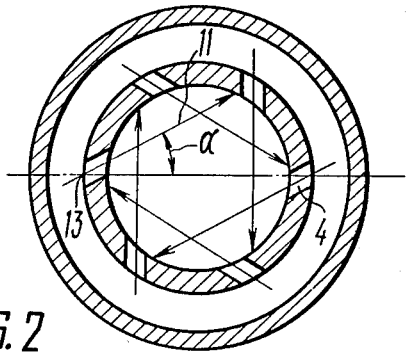
FIG. 2 is a section taken along line II—II in the vortex stage of the jet pump.

As we have stated above, the through channels of the mixing chamber 1 are arranged in two circular rows 4 and 5 (FIGS. 1, 2, 3) shown one above the other in the drawing, these rows being displaced nearer to the inlet end 3 of the mixing chamber 1. Each channel has an inlet end and an outlet end.

The axis 11 of each channel in the first row along the direction of flow of the transferred fluid is inclined to the cross-sectional flange of the mixing chamber 1 in the direction of flow of the transferred fluid, at the same angle $\beta$ which varies from 60° to 70°. This angle $\beta$ is so selected as to provide for the optimum conditions of creating the artificial whirlwind.

Besides, the axis 11 of each channel in this row 4 is additionally inclined at the same angle $\alpha$ to the plane passing through the longitudinal axis 12 of the mixing chamber 1 and through the point 13 where the axis 11 of the corresponding channel intersects the outer surface of the mixing chamber 1. These angles $\alpha$ vary from 29° to 31°. This is explained by the fact that the best results obtained during the tests of the pilot specimens of the pumps were shown by the pumps in which the channels of this row were arranged in such a manner that the axes of these channels projected on the cross-sectional plane of the mixing chamber formed rectilinear polygons with the number of sides divisible by three.

The channels in the first row 4 along the flow of the transferred fluid, inclined both to the cross-sectional plane of the mixing chamber 1 and to the planes passing through the longitudinal axis 12 of the mixing chamber 1 and through the points 13 where the axes 11 of the corresponding channels intersect the outer surface of the mixing chamber 1 form a vortex stage whose function is to impart rotary and progressive motion to the transferred fluid.

The axis 14 of each channel in the row 5 following the vortex stage is inclined at the same angle $\beta$ only to the cross-sectional plane of the mixing chamber. These angles are selected to vary from 60° to 70° on the basis of the above-mentioned considerations.

The channels in the row 5 are inclined only to the cross-sectional plane of the mixing chamber 1 and the injecting stage which is intended to build up a high-pressure zone throughout the cross-sectional area of the mixing chamber 1 and particularly along its longitudinal axis 12, thus imparting progressive motion to the transferred fluid.

The distance between the rows 4 and 5 of channels is selected in such a manner as to arrange the points of intersection of the channel axes 11 of the vortex stage with the inner surface of the mixing chamber 1 and the point 15 of intersection of the channel axes 14 of the injecting stage in one and the same plane 16 which is perpendicular to the longitudinal axis 12 of the chamber. The thickness of the wall of the mixing chamber 1 in the zone of the channel rows 4 and 5 is equal to at least twice the diameter of a single channel. It has been discovered that in this case the length of the channels prevents formation of local swirls in the conveying fluid.

The pump according to the invention operates as follows:

The conveying fluid, e.g. air, is delivered from a source (not shown in the drawing) through cylindrical holes 10 into the circular gap 7 of the header 6. Owing to the circular gap 7 formed by the header 6 and the mixing chamber 1, the conveying fluid is distributed uniformly around the mixing chamber 1 and builds up a uniform pressure in the zone of the inlet ends of the through channels.

From the header 6 the conveying fluid flows at a high velocity through the channels into the mixing chamber 1.

The conveying fluid passing through the row 4 of the vortex stage channels acquires a rotary and progressive motion and, encountering the walls of the mixing chamber 1, forms a "high pressure ring" of the conveying fluid.

The conveying fluid passing through the row 5 of the injecting stage channels at 60°–70° to the cross-sectional plane of the mixing chamber acquires a progressive motion and, owing to the arrangement of the channels ensuring the intersection of the jets of the conveying fluid at one point 15 lying on the longitudinal axis 12 of the mixing chamber 1, forms a "high pressure zone" along the longitudinal axis 12 of the mixing chamber 1.

The axes of the channels in the vortex and injecting stages are arranged in such a way that the high-pressure ring and the high-pressure zone lie in one and the same plane 16 which is perpendicular to the longitudinal axis 12 of the mixing chamber 1 and form the "high pressure plane" 16 of the conveying fluid. The functioning of the high-pressure plane reminiscent of the "air piston" which rotates and moves towards the outlet end 3 of the mixing chamber 1 thus ensuring efficient suction and conveyance of the transferred fluid.

In the case of a gaseous conveying fluid, e.g., a compressed and a liquid transferred fluid, the latter, e.g., slurry, becomes aerated which reduces its specific weight. This fact is of great importance, for example, in drilling wells by the indirect flushing method since at a sufficient depth it becomes possible to use additionally the airlift principle for the conveyance of slurry.

Thus, the suction of the jet pump according to the invention, is so efficient that, combined with the simplicity of design, this pump is capable of transferring such loose materials as gravel, sand, crushed stone, grain and liquids with coarse and fine inclusions and can be used in the devices for taking in, conveying and placing loose materials thereinto and for pumping out slurry used in drilling wells with the well face flushed out by the indirect flushing method. In addition, the pump according to the invention can be used in the device for the preparation of clay-like suspension.

Other objects and advantages of the invention will become apparent from the detailed description of the versions of the jet pump according to the invention.

Figure 4:
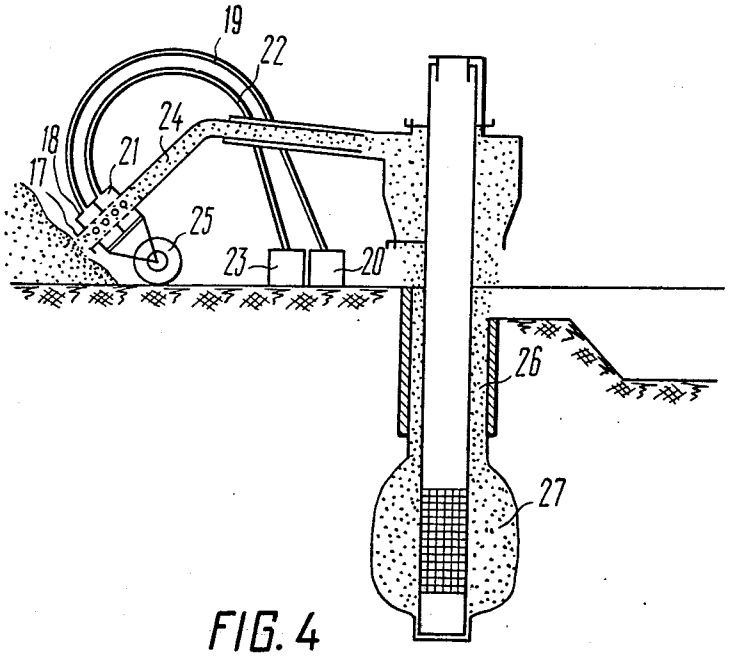
FIG. 4 shows a device for taking in, conveying and placing loose materials into a wide-contour well.

The device for sucking in, conveying and placing loose materials into a pump comprises a suction nozzle 17 (FIG. 4) connected to a jet pump 18 which latter communicates a hose 19 with a source of gaseous conveying fluid (compressor) 20 and whose outlet end is connected to another jet pump 21 by a hose 22 communicating with the source of a liquid conveying fluid (pump) 23. The jet pump 21 communicating with the source of the liquid conveying fluid 23 is connected at its outlet end with a telescopic conveying pipe 24. The suction nozzle 17, jet pumps 18, 21 and the telescopic conveying pipe 24 are secured on a trolley 25.

The device described above operates as follows: The trolley 25 together with the device for taking in and conveying the loose material is carried to the pile of the loose material (sand, gravel, crushed stone, grain). Then the compressor 20 is turned on, the compressed air is delivered through the hose 19 into the jet pump 18, which is located first along the flow of the loose material and acquires a rotary and progressive motion as has been described above. The jet pump 18 is so efficient in sucking in the transferred material that such loose masses as gravel and crushed stone are easily picked up by the suction nozzle 17 and moved together with the conveying fluid (air) into the telescopic conveying pipe 24 and further to the point of placement, e.g., into the well 26 with a wide contour 27 in the zone of the water-bearing horizon.

If the loose material contains clay particles or the like, sticking of said particles to the pipe walls is prevented by starting the pump 23 which delivers water through the hose 22 into the jet pump 21, which is second along the direction of movement of the transferred material. Entering the jet pump 21, the water acquires a rotary and progressive motion and washes the walls of the pipe 24 at a high speed thus protecting them against soiling and improving additionally the conveying characteristics of the device.

The device of the above-described design is useful for placing a loose material into the zone around the filter in the well having a wide contour 27 at or above the water level in order to reinforce the well holes and protect the extracted water against dirt.

Figure 5:
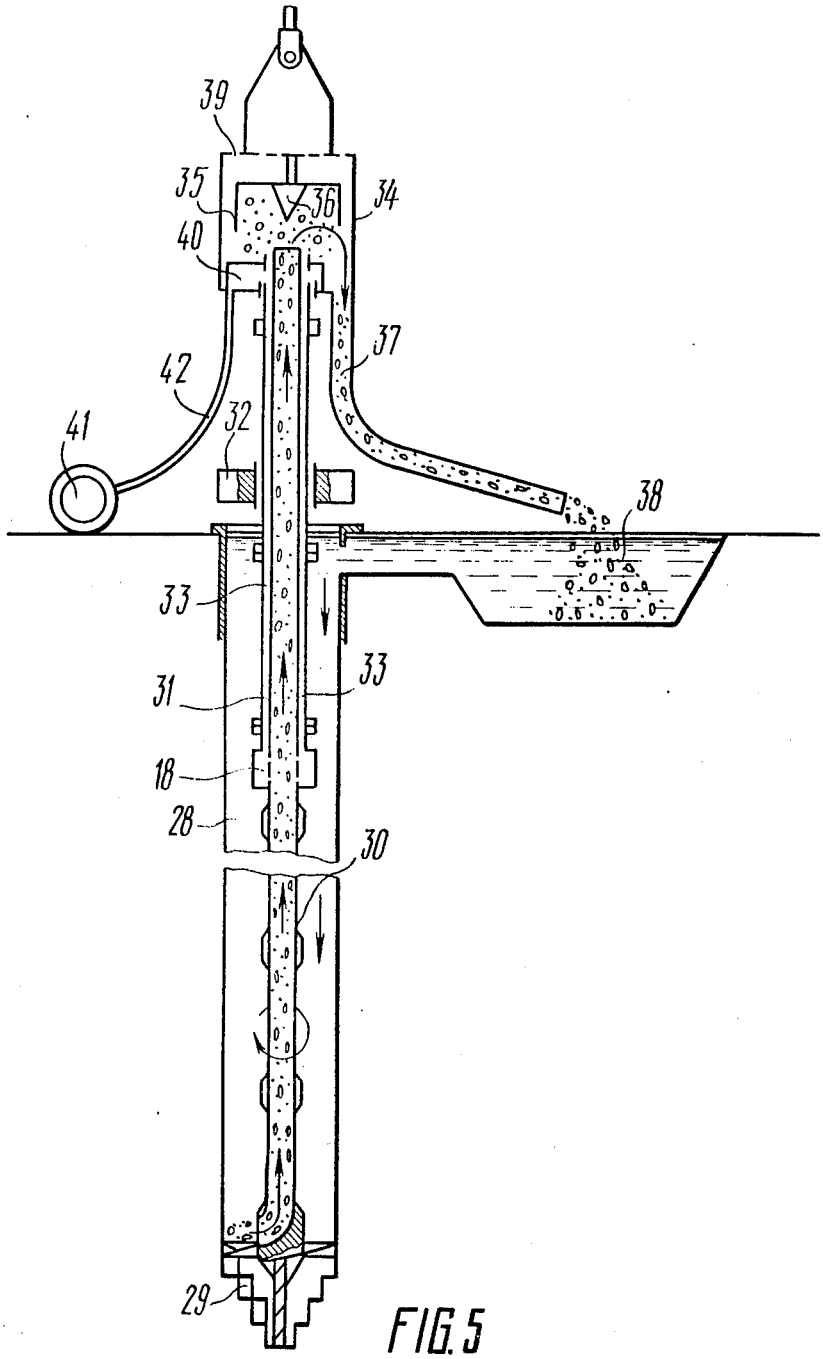
FIG. 5 shows a device for lifting out slurry during rotary drilling of wells with the well face cleaned by the indirect flushing method.

A device for pumping out slurry during rotary drilling of wells 28 (FIG. 5) where the well face is cleaned by the indirect flushing method comprises a hollow drilling bit 29 secured on the string of drilling pipes, a driving pipe 31 connected with the string of drilling pipes 30 and intended to transmit rotation from a rotor 32 to the string of drilling pipes 30, a jet pump 18 whose inlet end is rigidly connected with the string of drilling pipes while its outlet end is connected to the driving pipes 31 which are mounted with pipes 33 intended to deliver the conveying fluid, e.g., compressed air, into the jet pump 18. Secured to the driving pipe 31 is a swivel 34 combined with a chamber 35 for damping the hydraulic impact. The hydraulic impact damping chamber 35 accommodates an appliance 36 for dividing the flow of aerated slurry.

The hydraulic impact damping chamber 35 is connected with a pipe 37 for draining slurry into a settler 38 and through holes 39 in the upper portion of the swivel with the atmosphere. The swivel 34 accommodates an air chamber 40 through which the source of the conveying fluid 41 is connected by a hose 42 and pipe 33 with the jet pump 18.

The above-described device operates as follows:

The hollow drilling bit 29, jet pump 18, driving pipe 31 and swivel 34 which form the drilling rig are lowered 1 to 1.5 m deep on the bottom of a pit prepared and filled with fluid in advance.

Now the source of the conveying fluid 41 is set in operation. The conveying fluid flows through the hose 42, air chamber 40 and pipe 33 secured on the driving pipe 31 into the jet pump 18 where it passes through the vortex and injecting stages. Here the conveying fluid acquires a rotary and progressive motion which ensures sucking of the flushing liquid from the pit into the internal space of the drilling bit 29. As soon as the flushing liquid starts entering the jet pump 18 it is subjected to the action of the conveying fluid (air). Owing to this action the flushing liquid acquires a rotary and progressive motion, is additionally aerated and moves through the driving pipe 31. From the driving pipe 31 the aerated flushing liquid enters the swivel 34 combined with the hydraulic impact damping chamber 35. Here the flow of aerated flushing liquid impinges upon the appliance for driving the flow of aerated slurry 36 which is made in the form of a metal cone. This conical divider 36 takes the hydraulic impact of the moving flushing liquid and changes the direction of its flow, thus ensuring favourable conditions for the separation of air and flushing liquid. Being separated from the air, the flushing liquid moves through the slurry draining pipe 37 into a settler 38 while the separated air escapes into the atmosphere through the hole 39 in the cover of the hydraulic impact damping chamber 35. From the settler 38 the flushing liquid flows into the well 28 and thence into the inner space of the drilling bit 29 thus completing the cycle of its circulation.

As soon as the flushing liquid starts circulating, the rotor 32 is set in operation to impart rotary motion to the driving pipe 31, jet pump 18 and drilling bit 29.

At this moment the process of drilling begins. The rock crushed by the drilling bit 29 is mixed in the well face 28 with the flushing liquid and forms slurry, whereupon it flows through the hole of the drilling bit 29 into the jet pump 18 after which it circulates as described above leaving behind the disintegrated rock (drilling mud) in the settler 38.

After drilling the well 28 to a depth of 4 to 5 mm, a second piece of the driving pipe 31 4 to 5 m long is joined to the first piece and drilling is continued in an ordinary manner.

Drilling to a depth of 30 to 40 m is carried out with the jet pump constantly immersed into the well at least 5 to 9 m deep while drilling to a depth of 40 to 80 m calls for immersing the jet pump constantly into the well to a depth of not less than 9 to 14 m.

While drilling wells deeper than 100 m, the process of extending the drilling pipes is simplified by using the jet pump of the above-described design but with an internal air supply.

If necessary, the above-described device can be easily refitted for drilling wells with the well face cleaned by the direct flushing method.

Figure 6:
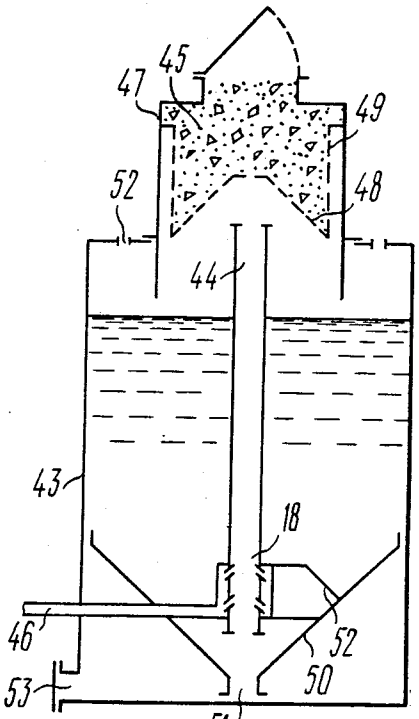
FIG. 6 shows a device for the preparation of clayey suspension.

The device for the preparation of clay-like suspension comprises a suspension reservoir 43 (FIG. 6) accommodating a rigidly secured jet pump 18 with an elongated outlet end 44; said outlet end 44 is directed towards the scouring-chamber 45 and connected by a pipe 46 with a compressor (not shown in the drawing); the scouring chamber 45 is combined with a loading hopper 47 and located in the upper part of the reservoir 43 above the outlet end 44 of the jet pump 18, the bottom 48 and walls 49 of the scouring chamber being provided with holes for the passage of fluid. The lower part of the reservoir accommodates a guide cone 50 intended to accumulate slurry and provided with a hole 51 for draining the clay-like suspension. The pump 18 is rigidly secured by junction plates 52 to the guide cone 50.

The above-described device functions as follows:

The reservoir 43 is filled with water while the loading hopper and the scouring chamber 45 are filled with clay. Then the compressor (not shown in the drawing) is started and begins delivering compressed air through the pipe 46 into the jet pump 18. Having passed through the vortex and injecting stages of the jet pump 18 the compressed air interacts with water inside the jet pump 18.

Due to this interaction the water is aerated and acquires a rotary and progressive motion inside the jet pump 18, flowing towards its outlet end 44. Leaving the jet pump 18 at a high speed, the jet of aerated water strikes the lumps of clay located on the bottom of the scouring chamber 45.

The clay lumps are disintegrated and the fluid carrying the particles of clay flows by gravity through the screen of the bottom 48 and through the holes in the side walls 49 of the scouring chamber 45 into the reservoir 43. The guide cone 50 located in the lower part of the reservoir 43 directs the liquid with the particles of clay towards the inlet end of the jet pump 18.

Owing to the sucking action of the pump 18 the liquid laden with the particles of clay is drawn into the mixing chamber of the jet pump 18 where it again acquires a rotary and progressive motion and flows at a high velocity towards the outlet end 44 of the jet pump 18.

The stream of fluid impinges upon the clay lumps in the scouring chamber 45 and breaks them down. The disintegrated and scoured out lumps of clay get mixed with the fluid and form a clay-like suspension of the required consistency.

The air used for the operation of the jet pump 18 is separated from water and expelled from the reservoir 43 through the holes 52 in the cover of the reservoir 43. The prepared clay-like suspension is discharged through the hole 53 in the wall of the reservoir 43.

What we claim is:

1. A jet pump having inlet and outlet ends comprising: a walled mixing chamber; through channels made in the walls of said mixing chamber for delivering a conveying fluid into said mixing chamber, said through channels being inclined along the movement of the transferred fluid, said through channels being arranged in said walls of said mixing chamber in at least two circular rows arranged one following the other in the direction of the transferred fluid, the axis of each of said channels in one of said rows being inclined to the cross-sectional plane of said mixing chamber in the direction of flow of the transferred fluid at one and the same angle and being additionally inclined at one and the same angle to the plane passing through the longitudinal axis of said mixing chamber and through the point where the axis of the corresponding of said channels intersects the outer surface of said mixing chamber, thus forming a vortex stage, whereas the axis of each of said channels in the other of said rows is inclined at the same angle with repect to the cross-sectional plane of said mixing chamber, thus forming an injecting stage, said row of channels of the vortex stage preceding said row of channels of the injecting stage along the flow of the transferred fluid, while the distance between said rows of through channels is selected in such a way that the points of intersection of said axes of the channels in said vortex stage with the inner surface of said mixing chamber and said point of intersection of said axes of channels in said injecting stage is arranged in one and the same plane perpendicular to the longitudinal axis of said mixing chamber.

2. A jet pump according to claim 1 wherein said angles formed by said axis of each channel in said vortex stage with the cross-sectional plane of said mixing chamber are the same and vary from 60° to 70° while said angles formed by the same axis of each channel with the plane passing through said longitudinal axis of said mixing chamber and through said point where said axis of the corresponding channel intersects the outer surface of said mixing chamber are the same and vary from 29° to 31°.

3. A jet pump according to claim 2 wherein said angles formed by said axis of each channel in said injecting stage with the cross-sectional plane of said mixing chamber are the same and vary from 60° to 70°.

4. A jet pump according to claim 2 wherein the number of channels in each row of said vortex and injecting stages is divisible by three.

5. A jet pump according to claim 2 wherein the thickness of walls of said mixing chamber in the zone of said channels is equal to at least twice the diameter of one channel.

6. A jet pump according to claim 1 wherein said angles formed by said axis of each channel in said injecting stage with the cross-sectional plane of said mixing chamber are the same and vary from 60° to 70°.

7. A jet pump according to claim 6 wherein the number of channels in each row of said vortex and injecting stages is divisible by three.

8. A jet pump according to claim 6 wherein the thickness of walls of said mixing chamber in the zone of said channels is equal to at least twice the diameter of one channel.

9. A jet pump according to claim 1 wherein the number of channels in each row of said vortex and injecting stages is divisible by three.

10. A jet pump according to claim 9 wherein the thickness of walls of said mixing chamber in the zone of said channels is equal to at least twice the diameter of one channel.

11. A jet pump according to claim 1 wherein the thickness of walls of said mixing chamber in the zone of said channels is equal to at least twice the diameter of one channel.

12. A jet pump according to claim 1 wherein said circular rows of channels are displaced nearer to the inlet end of said mixing chamber.

13. A jet pump according to claim 1 wherein the transferred fluid includes loose material for being sucked into, and conveyed by said pump, and further comprising a suction nozzle combined with the inlet end of the first jet pump, a second jet pump substantially similar to said first jet pump and located along the movement of the transferred material following said first jet pump, the outlet end of said first jet pump being combined with the inlet end of said second jet pump, and a telescopic pipe connected to the outlet end of said second jet pump.

14. A jet pump according to claim 1 for pumping out slurry during rotary drilling from a well having a well-face and a slurry drain pipe through well-face cleaning by indirect flushing through the slurry drain pipe, further comprising a drilling bit securable to a string of drilling pipes, a driving pipe including a rotor for transmitting rotation from the rotor to the string of drilling pipes, the inlet and outlet ends of said pump being rigidly connected with the string of drilling pipes and with said driving pipe, respectively, and a swivel secured to said driving pipe and accommodating a hydraulic impact damping chamber and an appliance for dividing the flow of aerated slurry, said chamber communicating with the slurry drain pipe and the atmosphere.

15. A device for the preparation of clayey suspension comprising: a scouring chamber with holes for the fluid in the walls and bottom; a reservoir for clayey suspension communicating with the scouring chamber; a loading hopper combined with said scouring chamber and located in the upper part of said reservoir; a jet pump intended to deliver fluid into said reservoir, the mixing chamber walls of said pump being provided with through channels which are intended to conduct the conveying fluid into said mixing chamber and are inclined in the direction of movement of the transferred material; said through channels of said jet pump are arranged in the walls of said mixing chamber in at least two circular rows located one after the other, the axis of each channel in the row which is first along the movement of the transferred material being inclined at the same angle towards the cross-sectional plane of said mixing chamber in the direction of movement of the transferred material and being additionally inclined at the same angle to the plane passing through the longitudinal axis of said mixing chamber and through the point where the axis of said corresponding channel intersects the outer surface of said mixing chamber, thus forming a vortex stage whereas the axis of each channel in the other row is inclined at the same angle to the cross-sectional plane of said mixing chamber, thus forming an injecting stage; the distance between said rows of through channels is selected in such a manner that said points of intersection of said channel axes in said vortex stage with the inner surface of said mixing chamber and said point of intersection of said channel axes of said injecting stage would be arranged in one and the same plane which is perpendicular to the longitudinal axis of said mixing chamber, said jet pump being rigidly secured in said reservoir and arranged in such a manner that the stream of fluid is directed from the elongated outlet end of the jet pump into said scouring chamber.

* * * * *